US007780000B2

(12) United States Patent
Mazzucchelli

(10) Patent No.: US 7,780,000 B2
(45) Date of Patent: Aug. 24, 2010

(54) ANTI-THEFT DISPLAY CONTAINER

(75) Inventor: Corrado Mazzucchelli, Grumello del Monte (IT)

(73) Assignee: Plasti-Max, S.p.A., Grumello Del Monte (BG) (IT)

( * ) Notice: Subject to any disclaimer, the term of this patent is extended or adjusted under 35 U.S.C. 154(b) by 292 days.

(21) Appl. No.: 11/764,534

(22) Filed: Jun. 18, 2007

(65) Prior Publication Data

US 2007/0289964 A1 Dec. 20, 2007

(30) Foreign Application Priority Data

Jun. 20, 2006 (EP) ..... 06012620

(51) Int. Cl.
*B65D 85/30* (2006.01)
*A45C 13/10* (2006.01)
*B65D 6/00* (2006.01)

(52) U.S. Cl. ..... 206/308.2; 206/1.5; 220/8

(58) Field of Classification Search ..... 312/270.3, 312/270.1, 204, 409, 334, 330.1, 271, 273, 312/129, 127, 122, 119, 114, 107, 108, 111; 220/4.03, 8, 4.21, 326; 70/57.1; 206/308.2, 206/1.5, 18

See application file for complete search history.

(56) References Cited

U.S. PATENT DOCUMENTS 2,827,004 A * 3/1958 Luce et al. ..... 220/8
3,003,840 A * 10/1961 Katzin ..... 220/8
4,982,857 A * 1/1991 Sher ..... 220/4.03
5,016,772 A * 5/1991 Wilk ..... 220/8
5,385,400 A * 1/1995 Chen ..... 220/8
5,468,062 A * 11/1995 Finnegan ..... 312/298
5,579,940 A * 12/1996 Weiss et al. ..... 220/8
5,595,431 A * 1/1997 Mlakar ..... 312/409
5,680,949 A * 10/1997 Roesler ..... 220/8
5,782,372 A * 7/1998 Weiss et al. ..... 220/8
5,862,932 A 1/1999 Walsh
6,662,081 B1 * 12/2003 Jacober et al. ..... 206/528
2007/0241104 A1 * 10/2007 Huizingh et al. ..... 220/8

FOREIGN PATENT DOCUMENTS

EP 1087083 A 3/2001
GB 2323838 A 10/1998
GB 2401775 A 11/2004

* cited by examiner

*Primary Examiner*—Ehud Gartenberg
*Assistant Examiner*—Kaushikkumar Desai
(74) *Attorney, Agent, or Firm*—Hess Patent Law Firm, PC; Robert J. Hess

(57) ABSTRACT

An anti-theft display case for manufactured products; in particular, display cases that can be opened and re-closed to contain the product to be displayed and provided with means of maintaining the case closed up to completion of sale, so as to prevent the unauthorized removal of the product. The anti-theft display case is provided with at least one first portion and one second portion, one mobile in relation to the other between an open and a closed position, and a means of locking said portions in the said closed position. The second portion is formed from at least two pieces bound one to the other and mobile one in relation to the other telescopically to increase the volume of the display case.

4 Claims, 4 Drawing Sheets

Fig.5
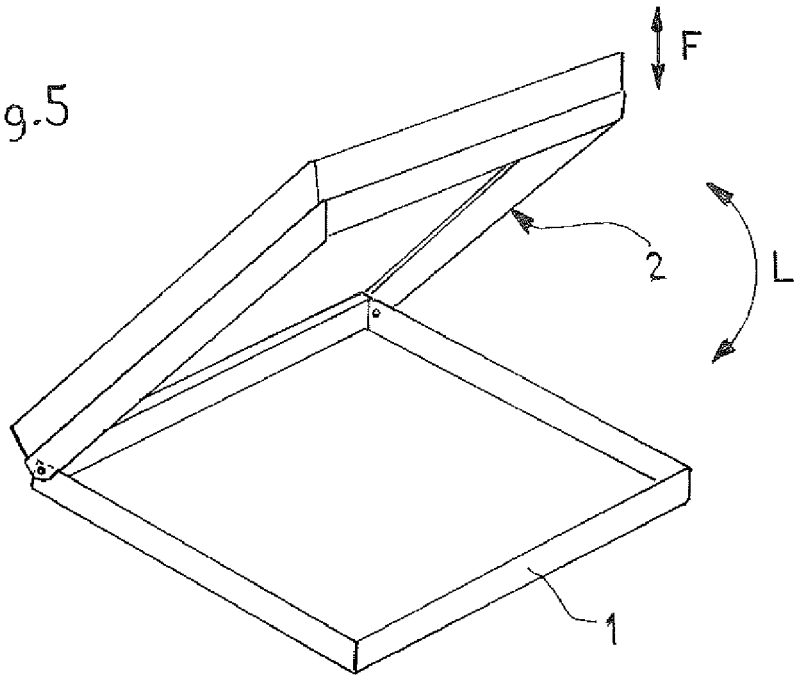
Fig.6
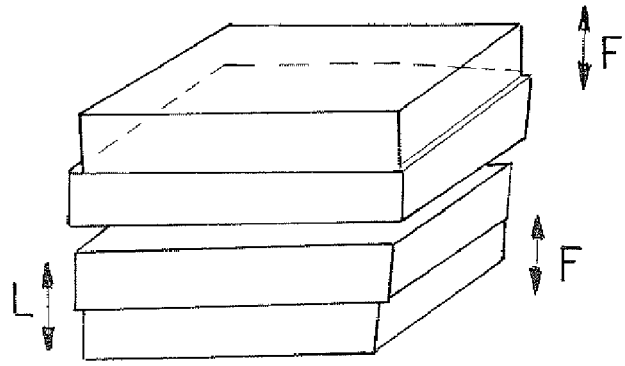
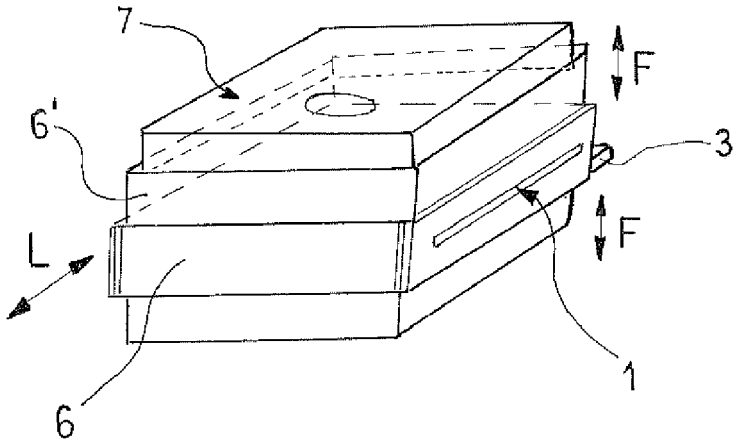
Fig.7

ANTI-THEFT DISPLAY CONTAINER

BACKGROUND OF THE INVENTION

1. Field of the Invention

The present invention relates to an anti-theft display case for manufactured products. In particular, the invention relates to display cases which can be opened and closed again to contain products for display, such as for instance CD disks, and provided with means of keeping the case closed until completion of the sale, to prevent unauthorized removal of the product.

2. Discussion of Related Art

Sale points characterized by the presence of numerous goods, even of different kinds, on display to the public have been known for a long time. Correct exposure of the goods on sale guarantees two immediate results: the first is to attract the attention of the customer, who, on seeing the products displayed, is induced to buy without real necessity; the other is a reduction of the personnel employed in the sale of single products with obvious economic advantages. The two things together lead to a considerable increase in sales, with obvious advantages for the trader.

The above is all the more true, the more products are displayed: the greater the display, the greater the sales. For this reason numerous shopping malls, food supermarkets and shops have been opened that operate on this system. The sales mechanism, typical for instance of retail distribution, based on display to the public and the ability to withdraw the displayed goods directly without having to ask the employed personnel, involves, however, the disadvantage of the relative ease with which the goods displayed can be removed and taken from the exhibitor, unknown to the employed personnel.

For this reason, anti-theft systems have been designed that comprise cases in rigid plastic inside which the objects to be displayed are placed. A typical example of an object to be displayed is a CD disk pack; the disk itself is contained in its own special box, enclosed in turn in a plastic film. The pack is in turn placed in a display case to prevent its unauthorized removal.

To such end, the display case comprises at least two parts that can be separated from each other to allow the product to be introduced inside the case. The display case is furthermore provided with means of locking the parts of the same together when they have later been rejoined so as to contain the product inside the case. The means of locking some parts of the display case together can be opened only with a special tool so that to prevent the extraction of the product from the case.

During the sale, the sales assistant unlocks the means of locking, opens the case by separating the two parts of the same one from the other and removes the sold product.

The display case now emptied of the sold product can be used again for the same purpose with another product that may be equal to or different from the product initially present in the case. In such a way, the case can be used many times.

The aforementioned display cases have the problem of being expensive. The moulds to produce them are expensive and are devoted to a single type of product: for instance a CD display case. The material used is expensive in as much as it has to have characteristics to be able to prevent the unauthorized opening of the display case and furthermore the presence of the means of locking further increases the costs.

There is, therefore, a need to produce an anti-theft display case that is economical, usable many times for more than one product—even for products different from each other, secure and easy to produce.

SUMMARY OF THE INVENTION

The purpose of the present invention is to resolve the aforementioned problems by a new and improved anti-theft display case. Such purpose is achieved by the present invention that relates to an anti-theft display case, having at least one first portion and one second portion, mobile in relation to each other between an open and a closed position and a means of locking said portions in the said closed position, characterized by said second portion being formed from at least two pieces bound one to the other and mobile one in relation to the other to increase the volume of the display case.

According to a preferential aspect of the invention, the second portion includes a first piece formed by a frame and a second piece mobile in a telescopic way in relation to the said frame.

According to a further aspect of the invention, there are a plurality of frames present lodged one inside the other and extendible in a telescopic way together with a final piece that can be either a frame or be closed.

According to a further aspect of the invention either the first or the second portion is provided with telescopically extendible pieces.

The anti-theft display case according to the invention has thus the great advantage of being able to vary its own volume according to the product to be contained; in this way, a case can be used with many different types of products. A second great advantage is given by the reduction of the costs of molding of the pieces: if before it was necessary to produce a mold for every case and a case for every type of product, due to the present invention it is enough to mould the mobile pieces; these are then assembled together to give the second (or even the first) portion of the case.

BRIEF DESCRIPTION OF THE DRAWING

These and other advantages will be obvious from the following description and the enclosed drawings, which are by way of illustration and not limiting, in which:

FIGS. 5, 6 and 7 are schematic views of further embodiments of the invention.

DESCRIPTION OF THE PREFERRED EMBODIMENT

Figure 1:
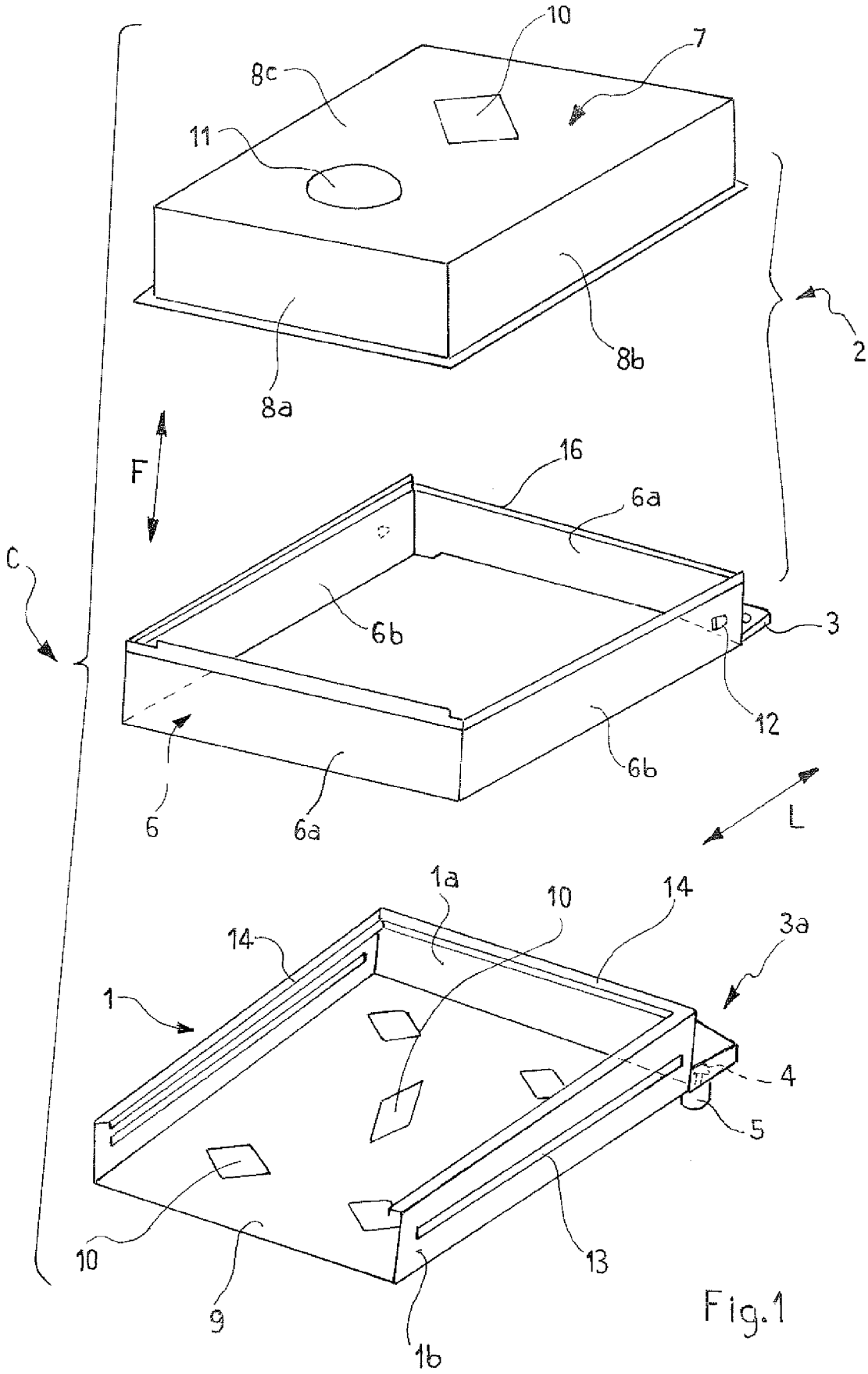
FIG. 1 is an exploded view of an embodiment of the case according to the invention.

With reference first to FIG. 1, the display case C according to the present invention includes at least one first portion and one second portion 2, mobile one in relation to the other between an open and a closed position and a means 3, 3*a* of locking said portions 1 and 2 in the closed position. In FIG. 1 (and FIG. 7), the case is of the type in which the first portion 1 forms a container into whose interior the second portion 2 runs in a longitudinal sense as a drawer, but other types of cases are also usable, such as those in which the two portions are hinged (FIG. 5) or mobile around the same pivot perpendicular to the plane of the case (FIG. 6).

In the embodiment shown, the means of locking includes a projecting portion 3 that extends from the frame 6 and that is provided with a passing hole which, when the case is locked, accepts a pin 4 which forms part of the complementary means of locking 3*a*. The pin 4 is integral with a base 4*a* in ferromagnetic material, that is normally kept in active position by a spring or analogous elastic means 5. When, during the sale of the product, the base 4*a* is positioned on a fixed magnet (not shown), it is attracted and moves vertically against the strength of the spring 5, lowering the spigot 4 into an unlocking position of the hole present on the projecting portion 3 of the portion of case 1.

Alternatively, other means known in the art can be used to give a lock reversing only with a special tool. Means of locking suited for the purpose and usable with the case according to the invention are for instance described in IT-B-01271604 and IT-B-01260045 in the name of the applicant, and in US-A-2005/0098455.

According to the present invention, one of the at least two portions comprising the case is formed from at least two pieces 6 and 7 that bound one to the other and render mobile one in relation to the other in the direction of the arrow F, to increase the volume of the display case when required.

To such end, the display case according to the invention has a second portion 2 that comprises a first piece 6 formed by a frame and a second piece 7 mobile in a telescopic way in relation to said frame. The piece 7 includes a plurality of walls 8*a*-8*c* that allow the product displayed to be retained inside the display case. Despite the material of the display case generally being transparent, preferably not colored transparent, the wall 8*c* of the piece 7 and the wall 9, opposite to the wall 8*c*, of the portion 1 preferably have some windows, or slots or apertures 10 for a better view of the product. The wall 8*c* has however a hole 11 that it has the function of means for handling the wall for the operations of unhooking portion 2 from portion 1.

The piece 6 of the portion 2 is shaped as a frame, or rather has only the four peripheral walls 6*a*, 6*b*. In alternative embodiments, such as that schematically shown in FIG. 7, to increase the volume of the case still more, the portion 2 includes two or more frames 6 and 6' lodged one inside the other and extendible in a telescopic way.

Figure 2:
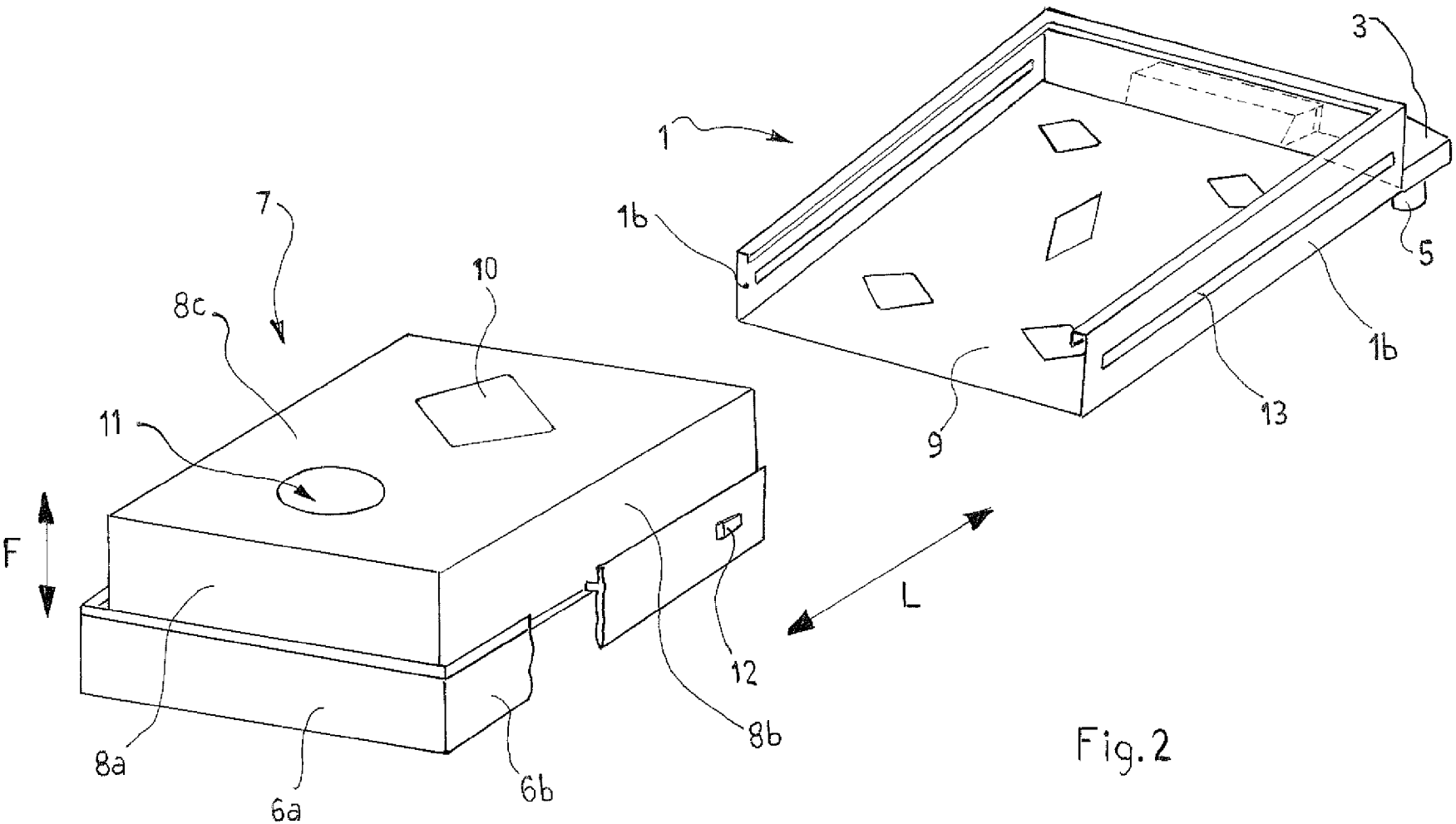
FIG. 2 is a perspective view of the embodiment of FIG. 1, partially assembled.

As described above, the second portion 2 is longitudinally mobile in relation to said first portion, in the direction of the arrow L of FIG. 2. The walls 6*b* of the frame 6 have each at least one tooth or lug 12 that is lodged in slots 13 formed on the walls 1*b* of the portion 1 of the case, to serve as end stops to the sliding movement of the frame 6.

Figure 3:
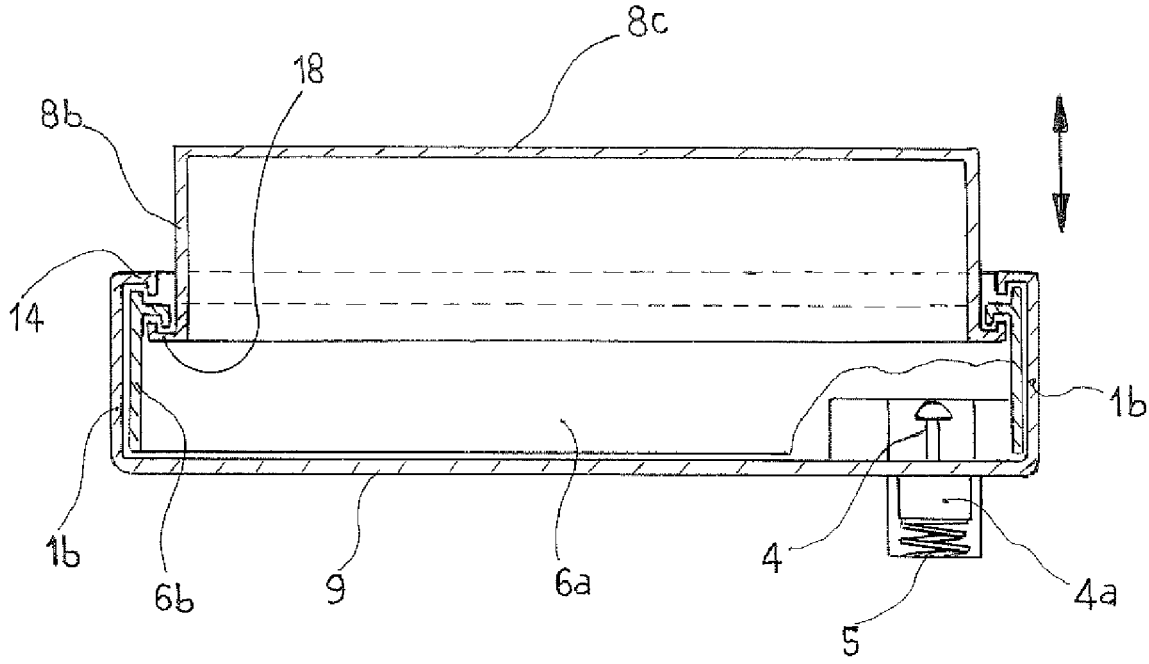
FIG. 3 is a view in cross-section of the embodiment of FIG. 1 assembled and in the position of maximum interior volume.
Figure 4:
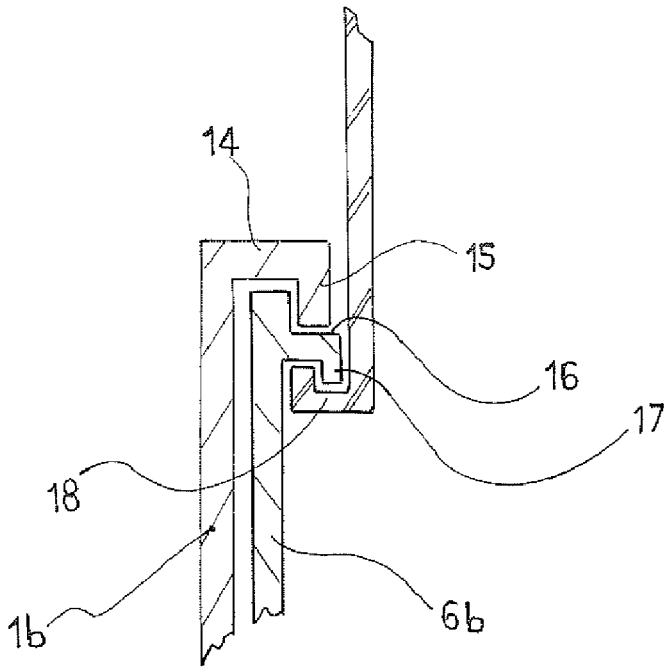
FIG. 4 is a view of a magnified detail of FIG. 3.

The means of binding and retaining the frame 6 and the complementary piece 7 in a vertical sense to portion 1 are shown in detail in FIGS. 3 and 4. As shown, the upper extremity of the sides 1*b* of the portion 1 are shaped as inverted "C" so as to comprise a horizontal portion 14 and a vertical portion 15 directed downward, parallel to the wall 1*b*. In the space thus formed between the walls 1*b*, 14 and 15 are lodged the extremities of the walls 6*b* that have in turn a profile 16 projecting horizontally toward the inside of the case under and adjacent to the wall 15. The profile 16 includes a vertical wall 17, projecting downward to engage the U-shaped lower edge 18 of the four walls 8*a* and 8*b* of the piece 7 of the second portion 2. The profile 16 extends along the four walls 6*a* and 6*b* of the frame 6 and the profile formed by the walls 14 and 15 it is extended around three walls 1*a* and 1*b* of the portion 2.

Due to the disposition and conformation of the extremities of the walls of the elements that form the case according to the invention, there is reciprocal engagement of the same and the possibility of movement of the frame 6 and of the piece 7 in relation to the portion 1 (arrow L) and of the piece 7 in relation to the frame 6 (arrow F), allowing the product to be displayed to be inserted into the case in a simple way and without tools, allowing the dimensions of the case to be increased up to almost three times the same if necessary, and preserving the inviolability of the case at the same time.

What is claimed is:

1. An anti-theft display case, having at least one first portion and one second portion, mobile one in relation to the other between an open position and a closed position to contain products for their display and a means for locking said portions in the closed position, said means for locking being openable by a magnet or a dedicated tool, characterized by said second portion being formed from at least two pieces bound one to the other and mobile one in relation to the other to vary a volume of the display case to accommodate the product to be contained, one of said pieces being locked to said first portion by said means for locking.

2. The display case of claim 1, wherein the means for binding and retaining includes configurations that complement each other, the configurations including an inverted C shape that defines a recess, a U shape that defines a recess, an outward projection that extends into the recess of the inverted C shape, an elongated extension with an end projection that extends in a direction substantially transverse to a direction of elongation of the elongated extension and into the recess of the U shape, the first portion having an edge with the inverted C shape, the telescoping piece having an edge with the U shape, the frame piece having the outward projection and the elongated extension with the end projection.

3. The anti-theft display case according to claim 1, wherein the means for locking carries out the locking of the first portion with the second portion by biasing a pin into entering a hole, the means for locking being responsive to urging of the pin against bias to move out of the hole to unlock the first portion from the second portion.

4. The display case of claim 3, further comprising a base supporting the pin, the base having a ferromagnetic material.

* * * * *